United States Patent [19]

Amir et al.

[11] Patent Number: 4,458,493

[45] Date of Patent: Jul. 10, 1984

[54] CLOSED RANKINE-CYCLE POWER PLANT UTILIZING ORGANIC WORKING FLUID

[75] Inventors: Nadav Amir, Rehovot; Meir Rigal, Moshav Benaya, both of Israel

[73] Assignee: Ormat Turbines, Ltd., Yavne, Israel

[21] Appl. No.: 389,873

[22] Filed: Jun. 18, 1982

[51] Int. Cl.[3] ..... F01K 7/06

[52] U.S. Cl. ..... 60/662; 60/664; 60/677; 415/199.6

[58] Field of Search ..... 60/641.1, 662, 664, 60/667, 677; 415/199.6

[56] References Cited

U.S. PATENT DOCUMENTS

| | | | |
|---|---|---|---|
| 1,469,965 | 10/1923 | Schmidt . | |
| 1,488,582 | 4/1924 | Allen . | |
| 1,526,792 | 2/1925 | Kasley . | |
| 2,063,194 | 12/1936 | Roy . | |
| 2,184,661 | 12/1939 | Bentley . | |
| 3,046,901 | 7/1962 | Montgomery . | |
| 3,048,018 | 8/1962 | Nicolin | 60/677 |
| 3,143,103 | 8/1964 | Zuhn . | |
| 3,306,044 | 2/1967 | Michel et al. | 60/662 |
| 3,369,175 | 2/1968 | Carter . | |

FOREIGN PATENT DOCUMENTS

| | | | |
|---|---|---|---|
| 162043 | 12/1979 | Japan | 60/667 |

*Primary Examiner*—Allen M. Ostrager
*Assistant Examiner*—Stephen F. Husar
*Attorney, Agent, or Firm*—Sandler & Greenblum

[57] ABSTRACT

A closed Rankine-cycle power plant (10) has a boiler (24) for vaporizing an organic working fluid and a first nozzle box (58) for receiving vaporized working fluid from the boiler (24) and for furnishing the fluid to a set of axial flow turbine blades (30) located on the periphery of a turbine rotor (50). The vaporized working fluid from the nozzle box (58) expands on passing through the blades (30) producing work that drives a generator (34) coupled to the turbine (28). A second nozzle box (62) receives vaporized working fluid that exits from the axial flow blades (30) on the rotor (50) and applies the working fluid to a second set of radial flow blades (66) on the rotor (50) adjacent the second nozzle box (62). Working fluid from the boiler (24) is applied directly to the first nozzle box (58), and in a selective, controlled manner, through a proportioning valve (26), working fluid from the boiler (24) is applied to the second nozzle box (62) thereby providing an efficient way to vary the work output of the turbine (28).

9 Claims, 2 Drawing Figures

CLOSED RANKINE-CYCLE POWER PLANT UTILIZING ORGANIC WORKING FLUID

TECHNICAL FIELD

This invention relates to an improved closed Rankine-cycle power plant utilizing an organic working fluid, and more particularly to an arrangement which permits the work output of a turbine to be varied within wide limits.

BACKGROUND OF THE INVENTION

A closed Rankine-cycle power plant utilizing an organic working fluid is disclosed in U.S. Pat. No. 3,393,515 wherein an organic working fluid is vaporized in a boiler and supplied to a turbine which, together with a generator, is mounted on a common shaft in a hermetically sealed cannister. Such apparatus is ideally suited for waste heat utilization wherein the thermal head available is relatively low; and in such case, Freon is a suitable working fluid. For the sake of simplicity and reliability, a single stage axial flow turbine is usually employed. The turbine is designed for a particular set of working conditions in order to maximize the electrical output produced by the generator. Oftentimes, however, the waste heat available fluctuates over a wide range; and while some control can be exerted on the turbine by reason of partial admission, essentially the variation in output of the turbine is confined to a relatively small range. When the waste heat available fluctuates to a larger degree, special means must be provided in order to protect the turbine. Usually, a bypass around the turbine is provided and the increased availability of waste heat cannot be utilized.

It is an object of the present invention to provide a new and improved closed Rankine-cycle power plant whose output can be varied over a greater range than is usually the case.

BRIEF DESCRIPTION OF INVENTION

According to the present invention, a closed Rankine-cycle power plant is provided comprising a boiler for vaporizing an organic working fluid and a first nozzle box for receiving vaporized working fluid from the boiler and for furnishing the fluid to a set of axial flow turbine blades located on the periphery of a turbine rotor. The vaporized working fluid from the nozzle box expands on passing through the blades producing work that drives a generator coupled to the rotor. A condenser condenses vapor exhausted from the turbine rotor; and the condensate is returned to the boiler via a pump.

A second nozzle box is provided for receiving vaporized working fluid that exits from the axial flow blades on the rotor, and a second set of radial flow blades is provided on the rotor adjacent the second nozzle box for expanding vaporized working fluid from the second nozzle box. Working fluid from the boiler is applied directly to the first nozzle box, and in a selective, controlled manner, through a proportioning valve, working fluid from the boiler is applied to the second nozzle box. Under the usual conditions of flow of the waste heat fluid, the proportioning valve disconnects the second nozzle box from the boiler which supplies working fluid to only the first nozzle box. After expanding through the axial flow blades, the working fluid passes through the second nozzle box and through the radial flow blades before being exhausted into the condensor.

When the state of the waste heat changes, and more heat is available for conversion to work, the change in state is sensed and the proportioning valve is operated so that working fluid from the boiler is sent directly into the second nozzle box. Thus, the work output of the turbine is increased by reason of increasing the flow of vapor at the boiler temperature; and for essentially the same turbine size and envelope, substantially more work can be obtained from the turbine on an as-needed basis.

BRIEF DESCRIPTION OF THE DRAWINGS

An embodiment of the invention is shown in the accompanying drawing wherein.

DETAILED DESCRIPTION

Figure 1:
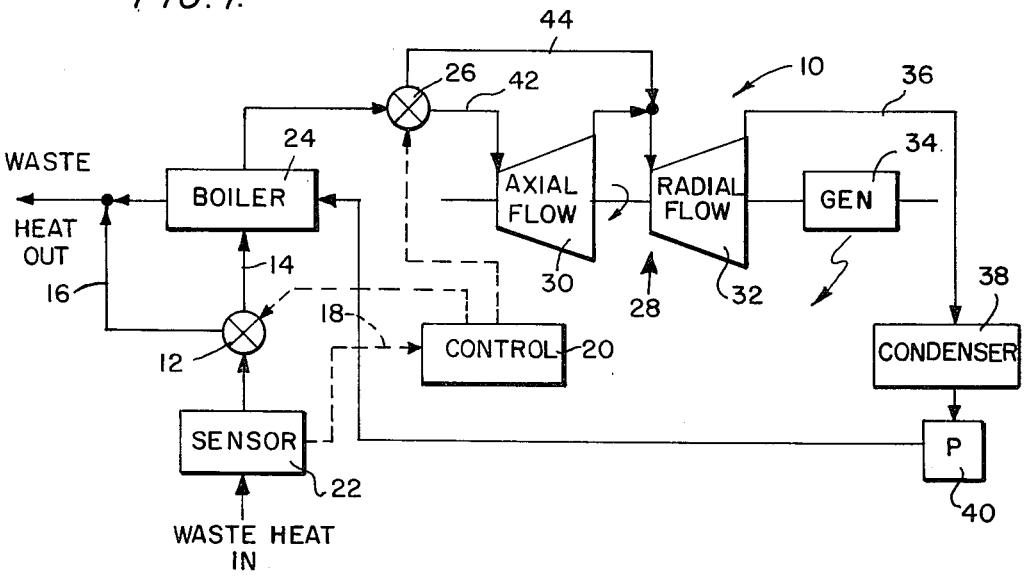
FIG. 1 is a block diagram schematically showing the operation of the present invention.

Referring to FIG. 1, reference numeral 10 designates a closed Rankine-cycle power plant according to the present invention operating with an organic fluid as the working fluid. Waste heat, from an industrial process, for example, is provided to proportioning valve 12 which divides the waste heat fluid into two paths 14, 16 in accordance with the output 18 from control 20 which senses the physical parameters of the waste heat fluid, such as its temperature, pressure, mass flow, etc., utilizing sensor 22.

Power plant 10 includes heat exchanger 24, which operates as a boiler, and is supplied with waste heat fluid from line 14 and with liquid organic fluid, such as Freon. The organic fluid is vaporized in boiler 24 by reason of the absorption of heat from the waste heat fluid, and the vaporized organic fluid is applied through proportioning valve 26 to organic fluid turbine 28 which, as described below, has a set of axial flow blades 30, and a set of radial flow blades 32 integrally associated with a rotor for the purpose of expanding the vaporized working fluid furnished by proportioning valve 26 and driving generator 34 which produces electricity. Vaporized working fluid, at a temperature and pressure lower than the temperature and pressure in the boiler, is exhausted via exhaust line 36 into condensor 38 which, may be air or fluid cooled, thereby producing condensate which is returned to boiler 24 by pump 40.

Previous to the present invention, turbine 28 would be designed for the average state of the waste heat fluid so as to operate at its greatest efficiency in converting a certain proportion of the heat in the waste heat fluid into electrical energy. When the state of the waste heat would change, for example, by a change in the mass flow or temperature of the waste heat fluid, sensor 22 would sense the change allowing control 20 to modulate by-pass valve 12 thereby changing the degree of bypass of the liquid and maintaining the boiler 24 at its most efficient operating condition. Thus, prior to the present invention, the power plant would produce a substantially constant amount of electrical energy independently of the state of the waste heat fluid. The present invention, shown in FIG. 1, permits the energy output of the power plant to be modulated in accordance with the modulation of the state of the waste heat fluid.

Referring again to FIG. 1, the normal operating condition of the power plant would be such that control 20 operating on proportioning valve 26 would direct all of the vaporized working fluid through line 42 and line 44 would be deprived of vaporized working fluid. Thus, vaporized working fluid, at boiler temperature and pressure, would pass through axial flow blades 30 of turbine 28 and would exhaust into radial flow blades 32 of the turbine before entering exhaust line 36. By a proper design of the axial and radial flow blades in the turbine, most of the work would be extracted in the axial flow region which would operate at a peak design efficiency and a relatively small amount of additional work would be extracted from the working fluid exhausted from the axial flow blades as such fluid passes through radial flow blades 32.

When sensor 22 senses a change in state of the waste heat fluid, such as an increase in mass flow or an increase in temperature which would give rise to the presence of additional heat in the waste heat fluid, control 20 responds by adjusting proportioning valve 26 to allow the additional vaporized working fluid, produced by the additional heat supplied to boiler 24, to pass through line 44 thereby supplying vaporized working fluid at boiler temperature to radial flow blades 32. This allows substantial expansion of working fluid through the radial flow blades and causes turbine 28 to deliver additional work to generator 34 thereby increasing the power output of the generator. Control 20 monitors the state of the waste heat fluid and modulates proportioning valve 26 in accordance with the heat content of the waste heat fluid taking into account the flexibility of turbine 28 to utilize vaporized working fluid over a relatively wide range. Thus, power plant 10, according to the present invention, provides a much more flexible system for utilizing waste heat, a system which, within design limits, is capable of changing its power output to accommodate changes in the state of the waste heat fluid.

Figure 2:
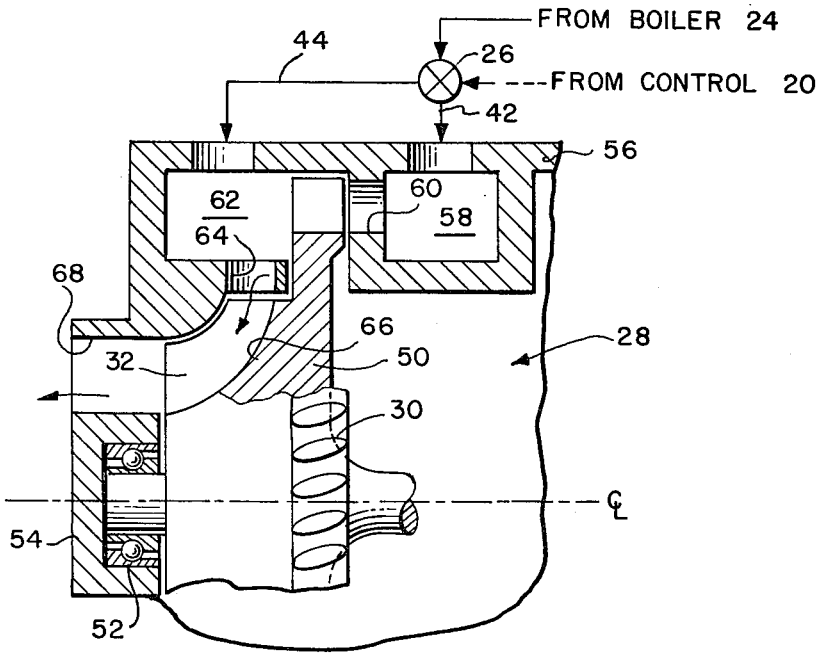
FIG. 2 is a view partially in section of a turbine according to the present invention.

FIG. 2, which reference is now made, is a detail of turbine 28 shown schematically in FIG. 1. Turbine 28 comprises turbine rotor 50 mounted in suitable bearings, one of which is shown by reference 52, carried in endplate 54 of cannister 56 which contains the rotor and generator 34 (not shown), hermetically sealing the rotating mass from ambient conditions. Rotor 50 is essentially a disk having at its periphery a plurality of axial flow blades 30 designed to accommodate vaporized working fluid at a given temperature and pressure consistent with the type of condenser utilized, the latter establishing the back pressure for the turbine. First nozzle box 58, which may be annularly shaped and which may extend partially or completely around the cannister inside thereof, receives vaporized working fluid from the boiler via line 42 containing proportioning valve 26 whose setting is determined by control 20.

Vaporized working fluid enters first nozzle box 58 and is applied to axial flow blades 30 on the turbine rotor via one or more nozzles 60 adjacent the axial flow blades. After the vaporized working fluid expands through blades 30, the working fluid is exhausted into second nozzle box 62 which is downstream of the blades 30. The second nozzle box extends 360° within cannister 56 and is provided with a plurality of nozzles 64 for directing vaporized working fluid in the second nozzle box into inwardly directed radial flow blades 32 which are located on a radial surface 66 of rotor 50. The working fluid passes radially through blades 32 and is turned in a horizontal direction by the blades into manifold 68 which is connected to exhaust line 36.

When sensor 22 senses a change in the state of the waste heat fluid, control 20 responds by causing proportioning valve 26 to direct vaporized organic fluid at boiler temperature into second nozzle box 62 via line 44. The additional working fluid added to nozzle box 62 via line 44 combines with the vaporized working fluid exhausted from axial flow blades 30 and expands in radial flow blades 32 allowing the turbine to produce additional work thereby causing the operative generator to increase. The modulation of valve 26 under the command of control 20 provides turbine 28 with a relatively wide range of work output thus accommodating wide changes in state of the waste heat fluid. Thus, with a single waste heat generator system in accordance with the present invention, greater utilization of the heat content of the waste heat fluid can be achieved, mainly in cases of greater heat content when the stream temperature is lower.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

We claim:

1. In a closed Rankine-cycle power plant having a boiler within which an organic fluid is vaporized, a nozzle box for receiving vaporized fluid from the boiler, a turbine rotor having a set of peripheral axial flow blades located adjacent the nozzle box for expanding vaporized fluid from the nozzle box and driving a generator, a condenser for condensing vapors exhausted from the turbine rotor, and means for returning condensate from the condenser to the boiler, the improvement comprising a second nozzle box for receiving vaporized fluid exiting from the axial flow blades on the rotor, and a set of radial flow blades on the rotor located adjacent the second nozzle box for expanding vaporized fluid from the second nozzle box.

2. The improvement of claim 1 including means for selectively furnishing vaporized working fluid to the second nozzle box directly from the boiler without passing through the axial flow blades.

3. A closed Rankine-cycle power plant comprising:

(a) a boiler for vaporizing an organic working fluid;

(b) a first nozzle box for receiving vaporized working fluid from the boiler;

(c) a turbine rotor having a set of axial flow blades located on the periphery of the rotor adjacent the first nozzle box for expanding vaporized working fluid from the nozzle box and driving a generator;

(d) a condenser for condensing vapor exhausted from the turbine rotor to produce condensate;

(e) means for returning condensate from the condenser to the boiler;

(f) a second nozzle box for receiving vaporized fluid exhausted from the axial flow blades; and (g) a set of radial flow blades on the rotor adjacent the second nozzle box for expanding vaporized fluid from the second nozzle box.

4. A closed Rankine-cycle power plant according to claim 3 including means for selectively admitting vaporized working fluid from the boiler into the second nozzle box.

5. A closed Rankine-cycle power plant according to claim 4 including means for controlling the percentage of working fluid in the second nozzle box directly from the boiler as compared to the working fluid applied to the first nozzle box.

6. A closed Rankine-cycle power plant according to claim 5 including a proportioning valve for controlling the distribution of working fluid from the boiler to the nozzle boxes.

7. A closed Rankine-cycle power plant according to claim 6 including means for modulating the proportioning valve.

8. A closed Rankine-cycle power plant according to claim 7 including a source of waste heat for supplying heat to the boiler.

9. A closed Rankine-cycle power plant according to claim 8 including means for monitoring the state of the waste heat, and modulating the proportioning valve in accordance with the state of the waste heat.

* * * * *